US007182097B2

(12) United States Patent
Busani

(10) Patent No.: US 7,182,097 B2
(45) Date of Patent: Feb. 27, 2007

(54) ANTI-SATURATION DIRECTIONAL CONTROL VALVE COMPOSED OF TWO OR MORE SECTIONS WITH PRESSURE SELECTOR COMPENSATORS

(75) Inventor: Ulderico Busani, Reggio Emilia (IT)

(73) Assignee: Walvoil S.p.A., Reggio Emilia (IT)

( * ) Notice: Subject to any disclaimer, the term of this patent is extended or adjusted under 35 U.S.C. 154(b) by 212 days.

(21) Appl. No.: 10/919,346

(22) Filed: Aug. 17, 2004

(65) Prior Publication Data

US 2006/0037649 A1 Feb. 23, 2006

(51) Int. Cl.
*F15B 11/05* (2006.01)

(52) U.S. Cl. ..... 137/596; 137/625.39; 91/446

(58) Field of Classification Search ..... 137/596, 137/625.69, 625.39; 60/452; 91/447, 446
See application file for complete search history.

(56) References Cited

U.S. PATENT DOCUMENTS 5,138,837 A * 8/1992 Obertrifter et al. ..... 60/426
5,415,199 A * 5/1995 Claudinon et al. ..... 137/596
5,715,862 A * 2/1998 Palmer ..... 137/493.8
5,715,865 A * 2/1998 Wilke ..... 137/596
5,806,312 A * 9/1998 Kauss et al. ..... 60/445
5,857,488 A * 1/1999 Kobelt ..... 137/596
5,890,362 A 4/1999 Wilke
6,192,928 B1 * 2/2001 Knoell et al. ..... 137/596
6,532,989 B1 3/2003 Kauss
2004/0040294 A1 3/2004 Sagawa et al.

FOREIGN PATENT DOCUMENTS

DE 42 34 037 4/1994

* cited by examiner

*Primary Examiner*—Eric Keasel
*Assistant Examiner*—Cloud Lee
(74) *Attorney, Agent, or Firm*—Young & Thompson

(57) ABSTRACT

The invention relates to the field of hydraulic directional control valves and refers to an anti-saturation directional control valve (V) composed of two or more sections in each of whom there is a pressure selector compensator with a six-way two-position spool (4) of the proportional type and a compensator (3) performing the function of pressure compensator. The pressure compensator (3) comprises therein a pressure signal selector (S), that is mechanically kept open or not by a piston (5) with a spring (M), of a negligible force, depending on workport pressures. The piston (5) presses against the pressure compensator (3) in the section (E) of the directional control valve (V) that is at a higher pressure, in this case operating as check valve, while in the sections at lower pressure the piston (5) is kept detached from the pressure compensator (3) so that this latter one performs its function of pressure compensator and the inner signal selector (S) by means of the sphere action.

9 Claims, 2 Drawing Sheets

ANTI-SATURATION DIRECTIONAL CONTROL VALVE COMPOSED OF TWO OR MORE SECTIONS WITH PRESSURE SELECTOR COMPENSATORS

The present invention refers to an anti-saturation directional control valve composed of two or more sections with pressure selector compensator.

Function of directional control valves is opening, closing or sheering the oil flow by means of control signals that can be of the manual, pneumatic, hydraulic or electric types.

In general, they are composed of a hollow body in which a moving element slides, called drawer or spool, that, depending on its assumed position, connects the different circuit lines respectively to fluid delivery or return.

The directional control valve spool can accurately assume its positions, immediately providing as output the full flow-rate or completely shutting the flow off; in this case, these are directional control valves with "on-off" output.

On the contrary, if the spool can assume, in addition to its end positions, infinite intermediate positions (metering positions) so as to be able to obtain variable flows, these are proportional directional control valves.

In this case, the sliding element or spool also automatically performs the function of non-compensated flow-rate control valve. In a non-compensated flow-rate control valve, the flow-rate is affected by input and output pressure variations.

In order for the abovementioned variation not to affect the flow-rates, it is necessary to use another component, called pressure compensator, which keeps the pressure drop $\Delta P$ constant through the spool and therefore keeps the flow-rate on the directional control valve ports unchanged.

Inserting a pressure compensator therefore makes the flow-rate univocally linked to the spool stroke and independent from the load.

Since the section workports are two, the section itself with its related spool is designed so that the only pressure compensator intervenes indifferently on both workports.

When mobile machines are dealt with, the use of many sections in a single block called directional control valve is widely spread.

Globally, there is a number of sections equal to the number of actuators to be served.

The operator, acting on the control lever, gradually moves the directional control valve spool and controls the spool orifices.

In case the simultaneous use of many actuators requires a global flow-rate that is higher than the maximum pump flow-rate, the system comes to "saturation".

In order to solve such inconvenience, a suitable choice and arrangement of the pressure compensators are necessary so that the flow-rate reduction on the working ports, with respect to the one defined by the spool strokes, is percentually shared among all working ports.

Such solution, called anti-saturation, allows, keeping if not the desired speeds, the relative movement between the actuators similar.

Directional control valves arrangements that solve the majority of the above-mentioned problems are already known in the art.

A first prior art example is shown in U.S. Pat. No. 4,719,753 in which one pressure compensator is provided for every workport instead of one for every section, this resulting in the use of twice the number of pressure compensators for the same number of workports.

Moreover, as can be read from the patent, the signal sent from the workport with higher pressure to all pressure compensators and to the pump pressure compensator is the one of the workport downstream of the pressure compensator with higher pressure. In order to avoid the load dip, this is not directly sent but copied (by means of a four-way two-position spool, that is not on-off but able to assume intermediate positions continuously) taking off oil upstream of the pressure compensator (between spool and pressure compensator).

It must be remembered that the pressure drop effective to determin the flow-rate through the spool is given by the stand-by imposed by the pump less the fixed pressure losses between the pump and the signal taking off point. Being this latter one taken off downstream of the pressure compensator, also its losses are negatively affecting the effective pressure drop. At maximum flow-rates, it is easy to have 1–2 bars of pressure losses that on a stand-by that can range from 10 to 20 bars can be equal to 10–20%. Moreover, the workport pressure taken off downstream of the pressure compensator on the section with higher pressure is imposed, by means of the pressure compensator in the section with lower pressure, upstream of the pressure compensator (between spool and pressure compensator). Therefore, in the section with lower pressure, the effective pressure drop is greater than in the section with higher pressure. It follows thereby that a reversal of the section with higher pressure generates an increase of the effective pressure drop over the one previously with higher pressure and vice versa, to which a step flow-rate increase corresponds and vice versa.

Another example is shown in U.S. Pat. No. 5,715,865: therein, the pressure signal is taken off upstream of the pressure compensator. Higher pressure value is sent, through a series of shuttle valves, to the pump and to all local pressure compensators including, however, also the one on the section with higher pressure.

It results that this latter one has the same pressure on both sides: should a spring be inserted in the classical check valve position (i.e. in the orifice closing direction through the pressure compensator itself) the pressure compensator would close the orifice; for this reason it is exactly placed in the opposite direction. Being built in this way, however, the pressure compensator does not work as check valve any more (due to the fact that it is normally open) from which the need arises of inserting a check valve apart inside the pressure compensator to avoid load dipping.

Moreover, as prior art example, U.S. Pat. No. 5,890,362 is mentioned, wherein the particular shape of the pressure compensator must be immediately taken into account, that here is divided in two in order to operate both as selector and as check valve.

In particular, the arrangement of pressures must be observed, that operate on the set of the two components of the pressure compensator disclosed in U.S. Pat. No. 5,890,362: at one end the pressure upstream of the pressure compensator is sent and at the other end the load sensing signal pressure is sent, that is taken off through the supply passage obtained in the body of the directional control valve and the bridge passage pressure (load pressure) arrives between the two components.

On the contrary, in the present invention, at one end of the pressure compensator the pressure upstream of the pressure compensator acts, while the workport pressure acts at the other end, while in the middle there is the load sensing signal, now taken off inside the pressure compensator itself.

Moreover, still in U.S. Pat. No. 5,890,362, the second part of the pressure compensator (valve element) operates as 2-way and 2-position valve for selecting the signal while the first part (poppet) performs the function of a check valve only after this first part has been detached from the second.

On the contrary, in the present invention, the second part is only a piston inserted in the same bore that, in the section with higher pressure, is always joined to the first part and, having at its ends the pressure upstream and downstream of the pressure compensator itself, operates as a check valve.

Moreover, always in the section with higher pressure, the piston, being kept joined to the first part, keeps the selector mechanically open allowing the pressure taken off upstream of the pressure compensator (not the one downstream of the pressure compensator with the already-described advantages) to arrive between the two parts and from here to the pressure compensators of the sections with lower pressure through a suitable passage.

In these latter ones, said signal detaches the piston from the first part that, having the signal pressure on one side and the pressure upstream of the pressure compensator on the other side, performs in all respects the function of pressure compensator (not of check valve as in the mentioned patent).

Moreover, the piston, by moving away, automatically closes the passage of the signal inside the pressure compensator itself.

Contrary to what has been said above, in U.S. Pat. No. 5,890,362, the pressure compensators of the sections with lower pressure perform the actual function of pressure compensator only if the parts are joined.

For the same reason, the arrangement of the spring in the pressure compensator is different, namely in U.S. Pat. No. 5,890,362 it can be found between the pressure compensator parts, moving the parts away, while in the present invention, it is arranged on one side like in a check valve.

Describing the technique adopted in U.S. Pat. No. 5,806,312, it must be observed the use of the pressure compensator as a selector, from which it stems that only in the section with higher pressure the pressure compensator is so lifted to open the internal hole towards the spring side of the pressure compensator itself, thereby taking the pressure upstream of the pressure compensator to the other pressure compensators and to the pump. On the contrary, the sections with lower pressure are less lifted, never getting to open such hole.

Since the pressure compensator, due to its function, has to open the passage between pump and workport before opening the signal hole, it is not able to prevent, in those transients where the workport pressure exceeds the pump pressure, the load from dipping.

It is therefore necessary to insert, downstream of the pressure compensator, check valves adapted to prevent such phenomenon.

The same Applicant has built a mono-block anti-saturation directional control valve for front loaders: excluding the specific application, the anti-saturation concept remains valid, that however is inserted in a mono-block directional control device, specifically for two hydraulic cylinders.

Object of the present invention is obtaining an anti-saturation directional control valve composed of two or more sections with pressure selector compensator that allows compensating the pressures on the workports and prevents system saturation when the simultaneous use of many actuators requires a global flow-rate that is greater than the maximum pump flow-rate.

Among the advantages that can be obtained from the present invention, in addition to having an object composed with a number of sections that is equal to the number of actuators to be fed that contain the same hydraulic layout, the following must be pointed out:

- Absence of load dipping transients due to the fact that the oil actuating the pump pressure compensator is taken off upstream of the pressure compensator: since this operates as check valve, it is therefore not taken off from the workport;
- Increase of effective pressure drop on the spool, which means a higher flow-rate with the same stand-by, namely a lower stand-by with the same flow-rate, namely lower energy losses. This because the stand-by imposed by the pump is between pump and workport downstream of the spool upstream of the pressure compensator;
- Absence of effective pressure drop steps and consequent flow-rate steps upon reversal of the workport with higher pressure due to the fact that the effective pressure drop is the same for all spools, both the one with higher pressure and those with lower pressure;
- Suppression of the need to insert check valves in the circuit to avoid load dipping phenomena: this function is performed by the pressure compensator during particular operating times;
- Reduction of hydraulic circuit complexity and above all reduction of tool machining to be carried out on each component due to the fact that the logic selector element is embedded in the pressure compensator itself, with consequent costs reduction.

These objectives and advantages are all obtained by the anti-saturation directional control valve composed of two or more sections, object of the present invention, that is characterised by what is provided in the below-listed claims.

These and other characteristics will be better pointed out by the following description of some embodiments shown, merely as a non-limiting example, in the enclosed tables of drawing in which.

Figure 1:
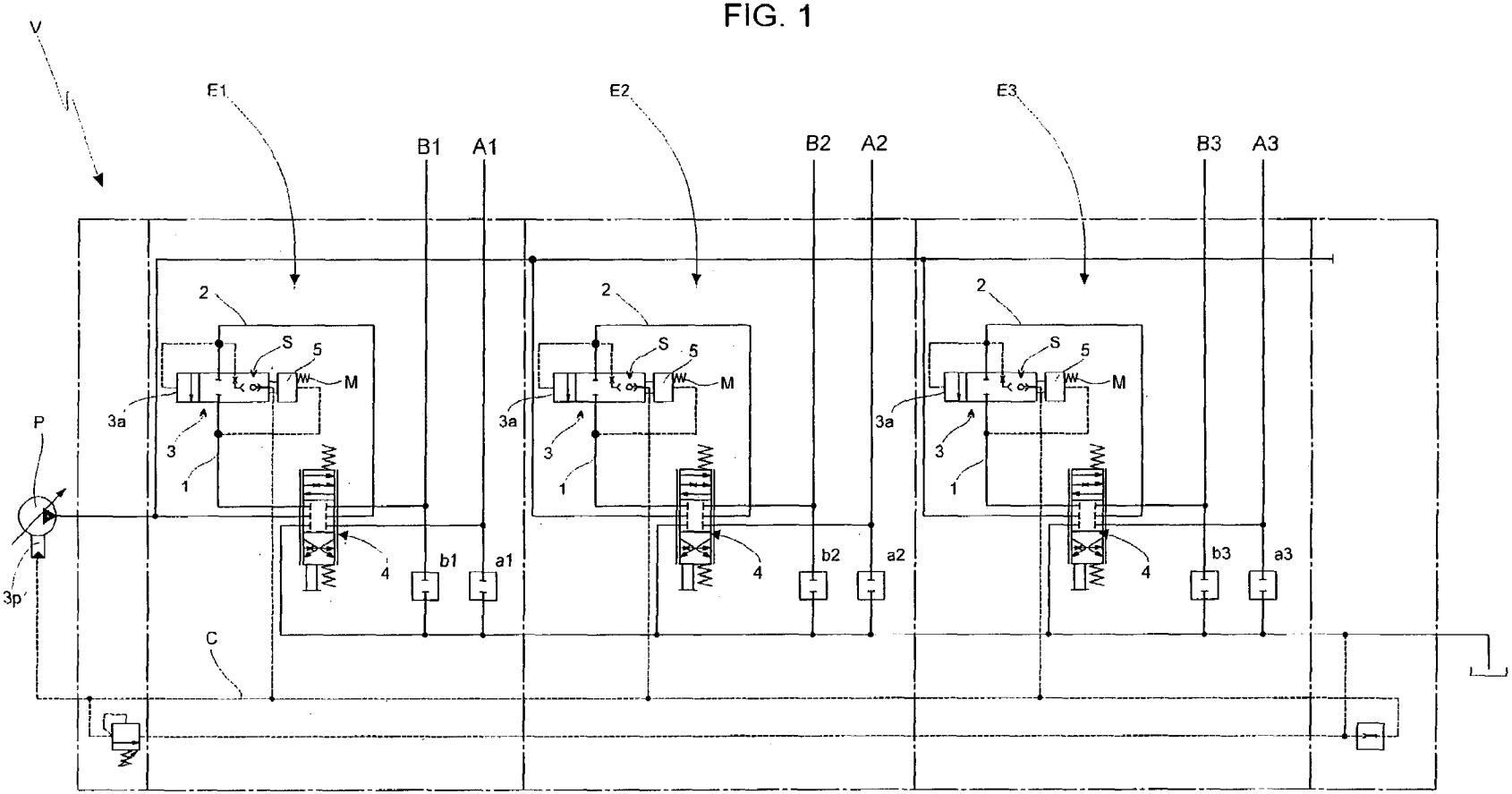
FIG. 1 shows the hydraulic circuit of the anti-saturation directional control valve composed of two or more sections with pressure selector compensator.

With reference to FIG. 1, the hydraulic circuit of a directional control valve (V) is shown, in which P designates a variable displacement pump that is hydraulically controlled and driven by means of the pressurised oil coming from line C.

The directional control valve is specifically composed of three sections E1, E2, E3, each one of which is connected to respective workports through the connections A1-B1, A2-B2, A3-B3.

Each section is equipped with a six-way, three-position spool 4, a pressure compensator 3 and a piston 5.

The pump P supplies each spool 4.

The pressure compensator 3 is characterised in having inside it a pressure signal selector S with sphere.

This selector S is kept mechanically open by a piston 5 when the pressure conditions so allow.

According to what is stated, the piston 5 is inserted in the same bore containing the pressure compensator 3. Moreover, a spring M with negligible force operates on the piston 5.

The load sensing signal is taken off through holes inside the pressure compensator 3 itself and not in the body of the directional control valve E.

Through the above holes, the pressure signal arrives to both sides of the pressure compensator 3.

On side 3*a*, where the resulting action is the opening of the orifice by means of the pressure compensator 3 itself, the signal directly arrives, taken off from point 2 upstream of the pressure compensator 3 (namely between pressure compensator 3 and spool 4), while on the other side the signal, still taken off from point 2, must pass through the selector S.

In practice, the selector S would not allow the passage of pressure incoming from point 2 if it were not been kept mechanically open by the piston 5 that is pressed against the pressure compensator 3 by the workport pressure taken off from point 1.

Supposing to actuate the spool 4 of the section E1, the pressure of the respective workport, taken off from point 1, arrives on the spring M side, namely arrives to operate on the piston 5 that in such a way presses against the pressure compensator 3 and keeps the selector S open by connecting point 2 to line C of the load sensing signal.

The piston 5 pushed against the pressure compensator 3 makes the group composed of pressure compensator 3 and piston 5 operate as a check valve.

Through the line C the pressure in point 2, namely between spool 4 and pressure compensator 3, arrives to the pump pressure compensator 3P, or alternatively, in case of fixed displacement pump, to the pressure compensator in the inlet cover, and is inserted between pressure compensator 3 and piston 5 of the other sections E2 and E3.

In the described configuration, the piston 5 of each section E2 and E3 is detached from the corresponding pressure compensator 3, so that the pressure compensator 3 finds itself with the load sensing signal at one end and the pressure upstream of the pressure compensator 3 itself at the other end 3*a*, with the result of operating as pressure compensator.

In this arrangement, in point 2 of sections E2 and E3 the pressure compensator imposes the same pressure in point 2 of the section with higher pressure E1 and the selector S inside the pressure compensators 3 of the sections E2 and E3 closes the connection between points 2 and line C of the load sensing signal.

A second section E2, with a lower workport pressure, is now assumed to be actuated: this pressure, taken off from point 1, arrives to the spring side of its own piston 5 that, being by hypothesis lower, does not move the piston 5 and the situation remains unchanged as previously stated.

On the contrary, it is now assumed to actuate an section E3 with higher pressure: a transient occurs in which the pressure in point 1 is greater than the pump delivery pressure with the risk of an undesired load dipping.

However, in section E3, the pressure in 1 moves its own piston 5 against its own pressure compensator 3 closing the orifice by means of the pressure compensator 3 itself towards the workport, thereby operating as check valve and preventing the load dipping.

Being no flow through the pressure compensator 3, the pressure in 2 reaches the pump delivery pressure, namely a pressure that is higher than the load sensing signal pressure of line C by an amount equal to the stand-by value, so that the selector S sphere opens till it joins the piston allowing such pressure to arrive at line C and to "short-circuit" towards the pump P itself, generating a pressure increase.

Only when the pressure in 2 exceeds the workport pressure, will the orifice towards the workport itself be opened again, confirming the behaviour as check valve.

At the same time, the load sensing signal of line C, being increased, detaches the piston 5 from the pressure compensator 3 in the section E1 that was previously at higher pressure, the selector S closes and the pressure compensator 3 detects the load sensing signal at one end and the pressure in point 2 (namely between spool 4 and pressure compensator 3) on the other end 3*a*, thereby operating as pressure compensator.

Due to what has been stated above, it must be summarised that in the directional control valve V of the invention, the section with higher pressure has its pressure compensator 3 that remains joined to the piston 5 in order to operate as check valve, while for the remaining sections, at lower pressures, the pressure compensator 3 is detached from its corresponding piston 5, by means of the load sensing signal arriving from line C, thereby operating as pressure compensator.

Figure 2:
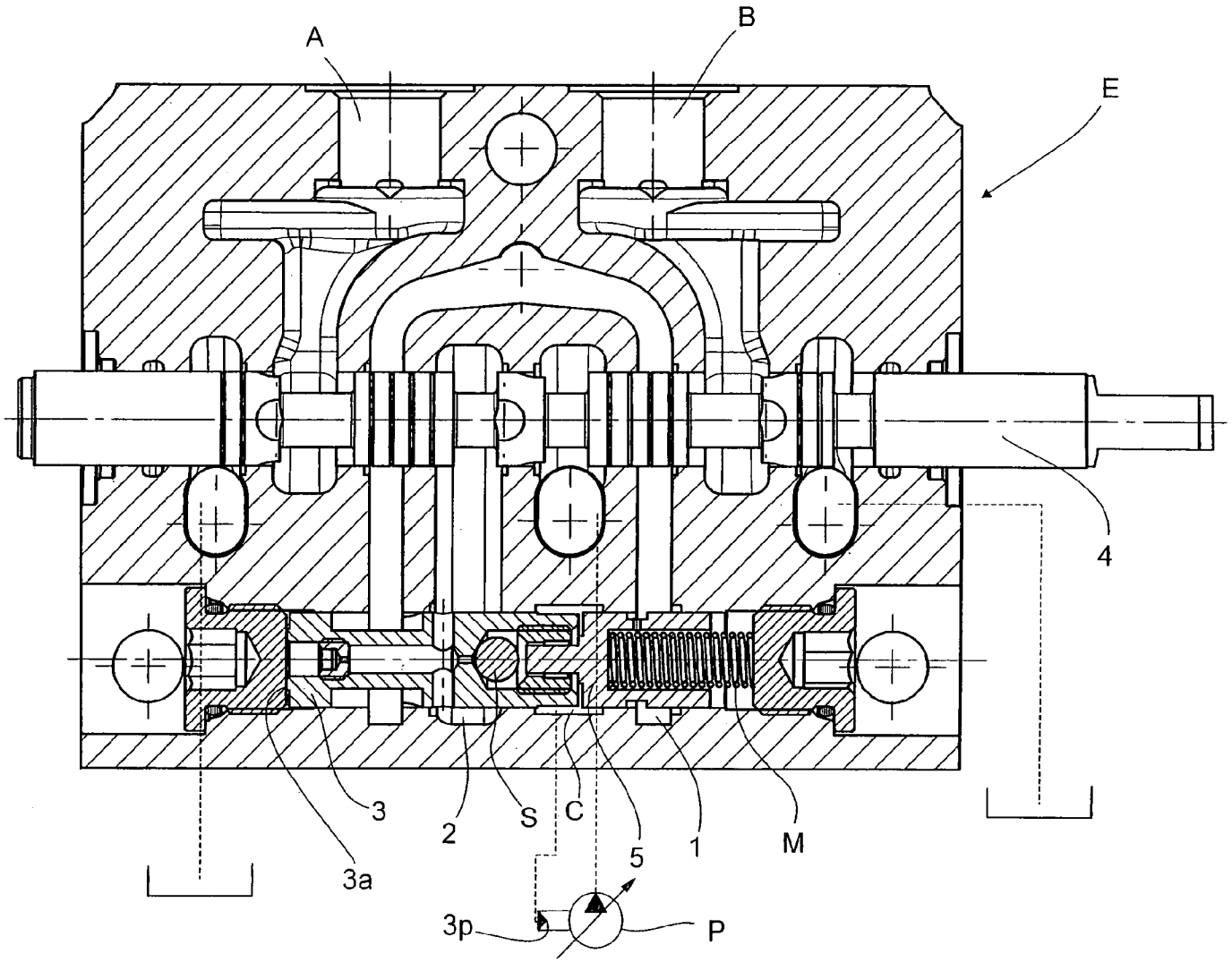
FIG. 2 shows a sectional view through a section of the directional control valve object of the present invention.

With reference to FIG. 2, a sectional view through a section E of the directional control valve V of the invention is shown, in which the previously-described components can be found.

In particular it is possible to note the arrangement of spool 4, pressure compensator 3 with selector S obtained (of which the sphere of said selector S is shown) and piston 5 with spring M beside.

From this, the evident constructive advantage of the directional control valve V of the invention can be observed, since this simple circuit has only two bores where in one bore the spool 4 is inserted and in the other bore pressure compensator 3 with its related selector S and piston 5 are inserted.

The invention claimed is:

1. An anti-saturation directional control valve (V) comprising: two or more sections with a pressure selector compensator, each section (E1, E2, E3) comprising i) a six way, three-position spool (4) of a proportional type, ii) a compensator (3) that performs a function of pressure compensator, the compensator inserted in a bore and comprising a pressure signal selector (S) with a sphere located inside the compensator (3), iii) a piston (5) inserted in the same bore as the compensator (3), and iv) a spring (M) that operates on said piston (5), wherein, a. a section workport provides a workport pressure that operates on the piston (5), on the spring (M) side, the workport pressure being taken off from a first point (1) between the compensator (3) and the work port, the pressure upstream of the compensator (3) operates on a side (3*a*) of the compensator (3) itself, such pressure being taken off from a second point (2), namely between spool (4) and pressure compensator (3), while a load sensing signal pressure operates between piston (5) and compensator (3), b. the pressure signal selector (S) is kept mechanically open or not by the piston (5) with spring (M) depending on the pressure on the workports, c. in a section with higher pressure the piston (5) push against the compensator (3) and the group composed of compensator (3) and piston (5) operates as check valve and the selector (S) kept open by the piston (5), connects the pressure signal in the second point (2), between spool (4) and compensator (3), to a line (C) of the load sensing signal.

2. The anti-saturation directional control valve (V) according to claim 1, characterised in that said load sensing signal arrives to a pump pressure compensator (3P) and acts between compensator (3) and piston (5) of lower pressure sections (E) of the directional control valve (V).

3. The anti-saturation directional control valve (V) according to claim 2, characterised in that the piston (5) is detached from the compensator (3) in the sections of the directional control valve (V) that are at a lower pressure; in such a way, the selector (S) closes and the compensator (3) performs its own function of pressure compensator.

4. The anti-saturation directional control valve (V) according to claim 2, characterised in that the compensator (3), the related selector (S) with sphere, the piston (5) and the spring (M) are inserted in the same bore of the compensator (3).

5. The anti-saturation directional control valve (V) according to claim 1, further comprising an inlet cover, characterised in that said load sensing signal arrives to a pressure compensator in the inlet cover and acts between compensator (3) and piston (5) of lower pressure sections (E) of the directional control valve (V).

6. The antisaturation directional control valve (V) according to claim 5, characterised in that the piston (5) is detached from the compensator (3) in the sections of the directional control valve (V) that are at a lower pressure; in such a way, the selector (S) closes and the compensator (3) performs its own function of pressure compensator.

7. The anti-saturation directional control valve (V) according to claim 5, characterised in that the compensator (3), the related selector (S) with sphere, the piston (5) and the spring (M) are inserted in the same bore of the compensator (3).

8. The anti-saturation directional control valve (V) according to claim 1, characterised in that the piston (5) is detached from the compensator (3) in the sections of the directional control valve (V) that are at a lower pressure; in such a way, the selector (S) closes and the compensator (3) performs its own function of pressure compensator.

9. The anti-saturation directional control valve (V) according to claim 1, characterised in that the compensator (3), the related selector (S) with sphere, the piston (5) and the spring (M) are inserted in the same bore of the compensator (3).

* * * * *